US005330167A

United States Patent [19]

Plumb

[11] Patent Number: 5,330,167

[45] Date of Patent: Jul. 19, 1994

[54] WORK HOLDER WITH SELF-ENERGIZING FRICTION LOCK

[76] Inventor: Edwin W. Plumb, 29 Linden Rd., Woodbury, Conn. 06798

[21] Appl. No.: 36,369

[22] Filed: Mar. 24, 1993

[51] Int. Cl.[5] ..... B25B 1/02

[52] U.S. Cl. ..... 269/43; 269/236; 269/153; 269/167; 269/196

[58] Field of Search ..... 269/906, 236, 196, 43, 269/166, 167, 198, 229, 235, 282, 283

[56] References Cited

U.S. PATENT DOCUMENTS

| | | | |
|---|---|---|---|
| 2,317,702 | 4/1943 | Wallace | 269/236 |
| 2,528,909 | 11/1950 | Plumb . | |
| 2,954,713 | 10/1960 | Gaubert | 269/196 |
| 4,046,363 | 9/1977 | Whitley | 269/236 |
| 4,202,540 | 5/1980 | Neff | 269/236 |
| 4,241,906 | 12/1980 | Cole | 269/906 |
| 5,035,135 | 7/1991 | Makela | 269/236 |

FOREIGN PATENT DOCUMENTS

| | | | |
|---|---|---|---|
| 678988 | 9/1952 | United Kingdom | 269/236 |

OTHER PUBLICATIONS

"Grip-Master Drill Press Vises Heinrich or MSC Economy" Catalog Page.
"Heinrich Drill Press Vises" Catalog Page.
"Kurt Double-Lock Vises and Bi-Lok" Catalog pp. 1428 and 1430.
"Kurt Cluster Lock" 2 Catalog Pages.

*Primary Examiner*—Robert C. Watson
*Attorney, Agent, or Firm*—Hayes & Reinsmith

[57] ABSTRACT

A work holding device is disclosed which has a fixed jaw and a movable jaw mounted on a pair of parallel guide rods for guiding the movable jaw toward and away from the fixed jaw. For moving and actuating the movable jaw, the guide rods are engaged by a handle operated cam member with a self-energizing frictional locking action responsive to handle movement.

25 Claims, 12 Drawing Sheets

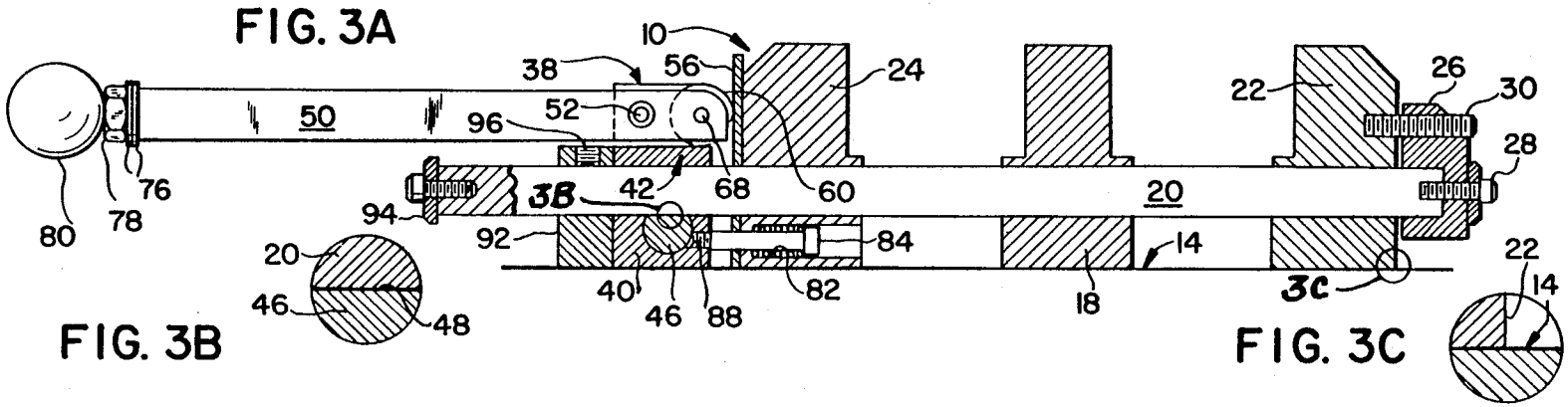
FIG. 3A
FIG. 3B
FIG. 3C
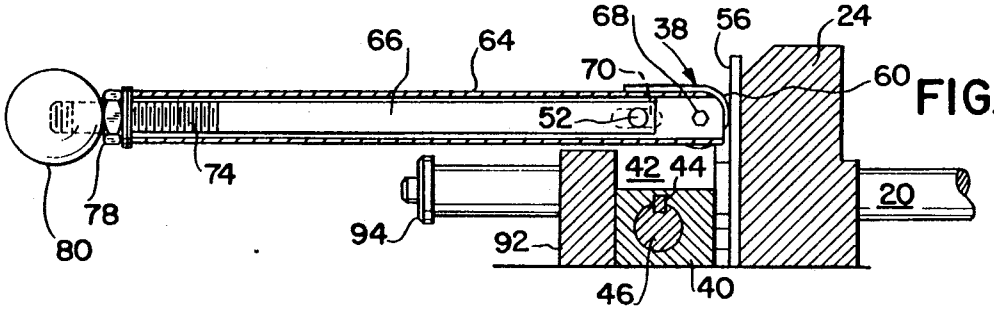
FIG. 4
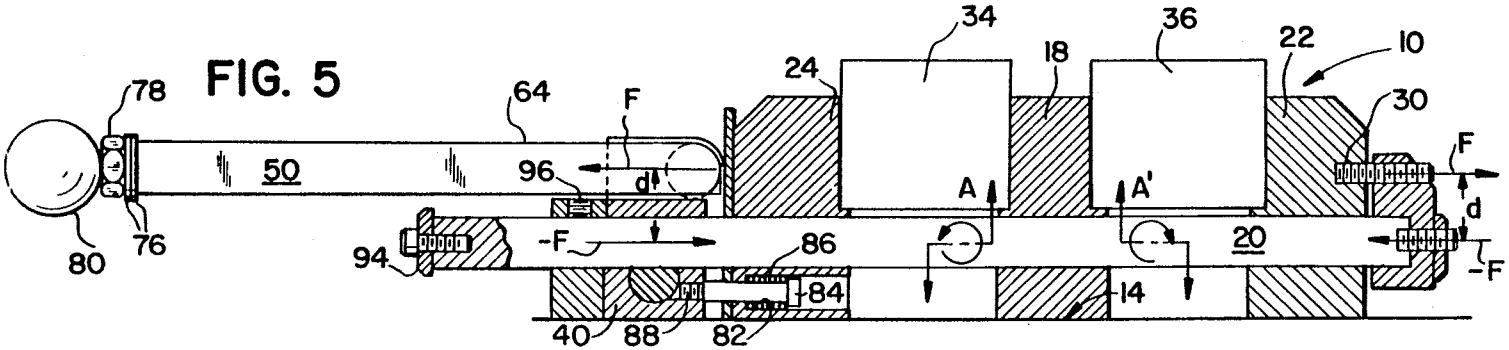
FIG. 5

WORK HOLDER WITH SELF-ENERGIZING FRICTION LOCK

FIELD OF THE INVENTION

This invention generally relates to work holding devices for clamping parts for subsequent machining operations and particularly concerns a unique device featuring a clamping mechanism with a self-energizing friction lock.

BACKGROUND OF THE INVENTION

Work holding devices are commonly used in machining parts and frequently require several separate time consuming steps for machine setup. The drawbacks of such conventional devices become increasingly evident when a multiplicity of such units such as vises are used, e.g., in a computerized numerically controlled (CNC) machining center. A variety of different fixturing devices are known and are available for clamping parts on a machine table. These devices, however, are limited to given part sizes, e.g., a maximum length per part, and frequently have a jaw opening capacity less than that desired for certain machining operations.

To allow simultaneous mounting and clamping of multiple parts, certain fixturing devices are known to be provided with a series of vises in a side-by-side arrangement with each vise having a fixed jaw disposed between a pair of movable jaws, all of which are then movable into preselected positions to accommodate parts of a given size.

OBJECTS OF THE INVENTION

A principal object of this invention is to provide a new and improved work holding device for quick and easy loading and unloading of workpieces while accommodating a variety of parts of different shapes and which is capable of minimizing undesired workpiece slippage under load for increased quality control and productivity.

Another object of this invention is to provide a new and improved device of the type described having a unique clamping mechanism featuring a self-energizing friction lock particularly suited for quick and easy operation to simplify machine setup and to speed production.

A further object of this invention is to provide a new and improved vise fixturing assembly mountable on a table and which features a unique jaw fixturing arrangement for minimizing tool changes in a compact, integrated, modular low profile assembly.

A yet further object of this invention is to provide a new and improved vise fixturing assembly of the type described particularly suited for use with CNC machining centers.

Other objects will be in part obvious and in part pointed out in more detail hereinafter.

SUMMARY OF THE INVENTION

A workpiece holding device of this invention includes a fixed jaw means, a movable jaw means, and a pair of rods to guide the movable jaw means toward and away from that fixed jaw means. A clamping mechanism is operatively connected to the movable jaw means. The mechanism includes a pivoting cam member selectively engageable with the rods for moving the movable jaw means relative to the fixed jaw means, the pivoting cam member being engageable with the rods automatically in a self-energizing frictional locking action. Another featured aspect of this invention is a vise fixturing assembly having a unitary fixed jaw of an elongated construction accommodating a series of individual pairs of movable jaws extending in side-by-side relation along the length of the fixed jaw.

A better understanding of the objects, advantages, features, properties and relations of this invention will be obtained from the following detailed description and accompanying drawings which set forth certain illustrative embodiments and are indicative of the various ways in which the principles of the invention are employed.

BRIEF DESCRIPTION OF THE DRAWINGS

FIGS. 3A, 3B, and 3C are side views, partly broken away and partly in section, showing the device of FIG. 1 with its clamp handle illustrated in a clamping position;

FIG. 4 is a side view, partly broken away and partly in section, showing certain details of a clamping mechanism of the device of FIG. 1;

FIG. 5 is a side view similar to FIG. 3, partly broken away and partly in section, with workpieces clamped between jaws of the device;

Figure 1:
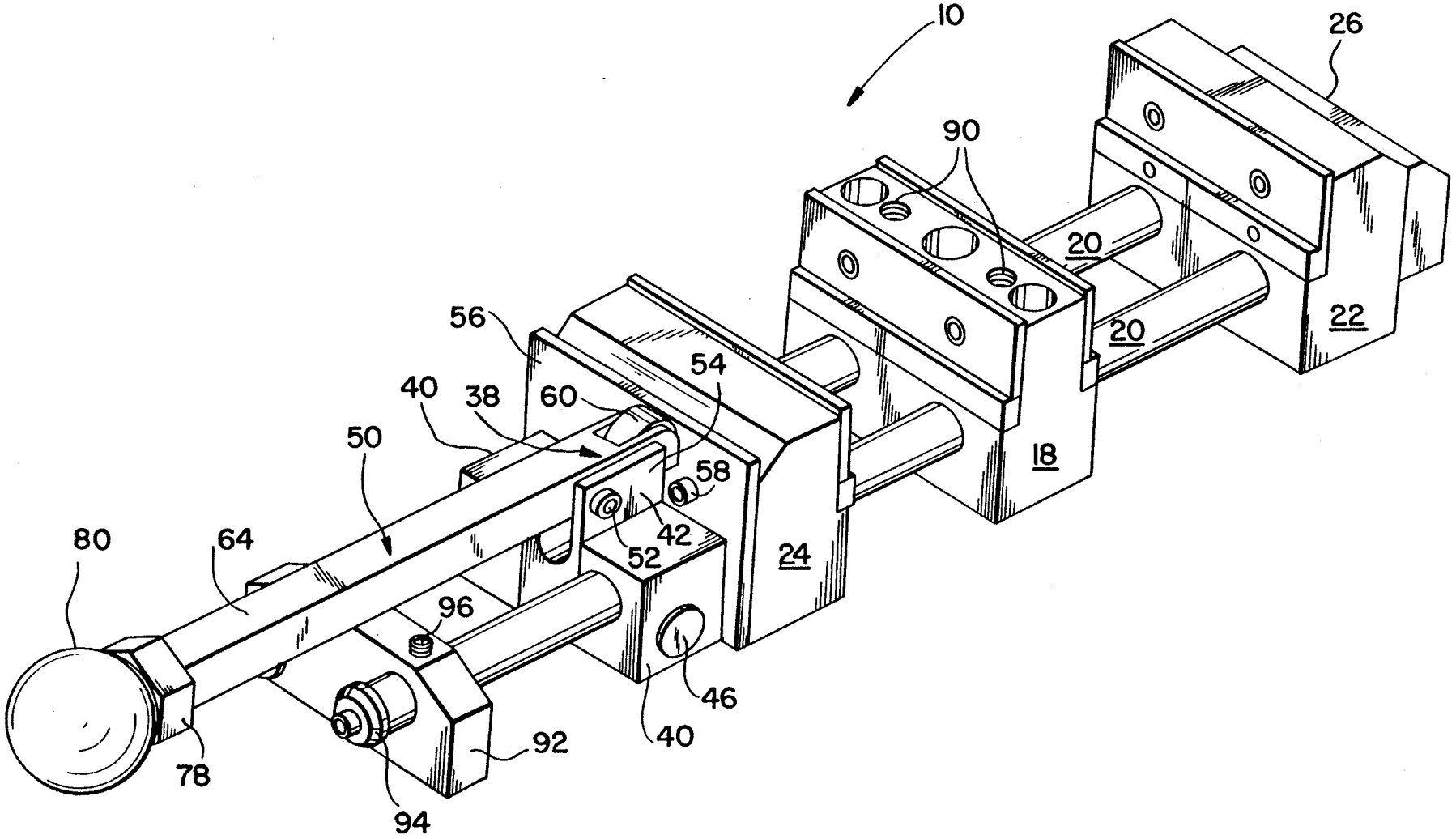
FIG. 1 is an isometric view showing an individual workpiece holding device incorporating this invention.
Figure 7:
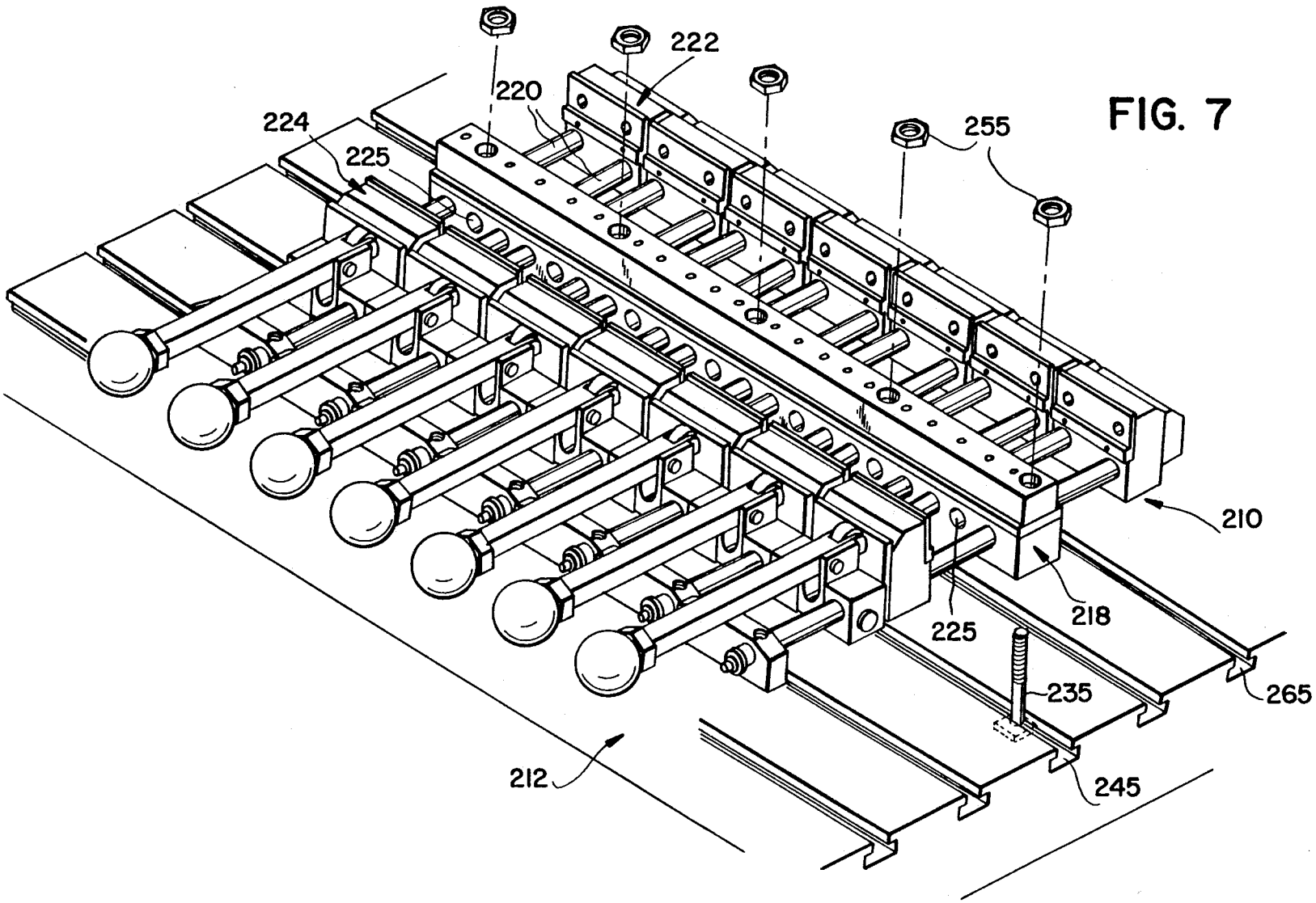
Figure 8:
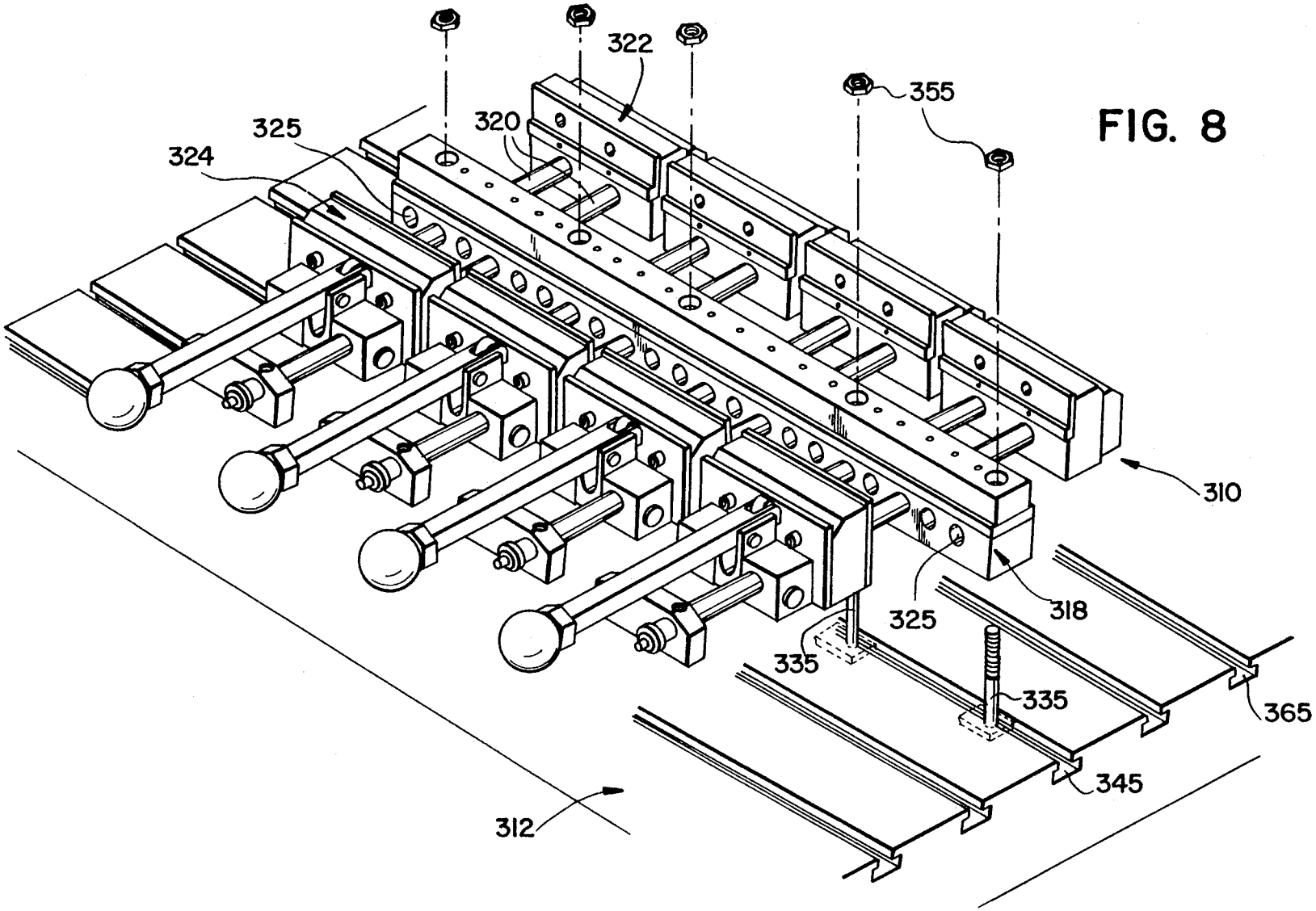
Figure 9:
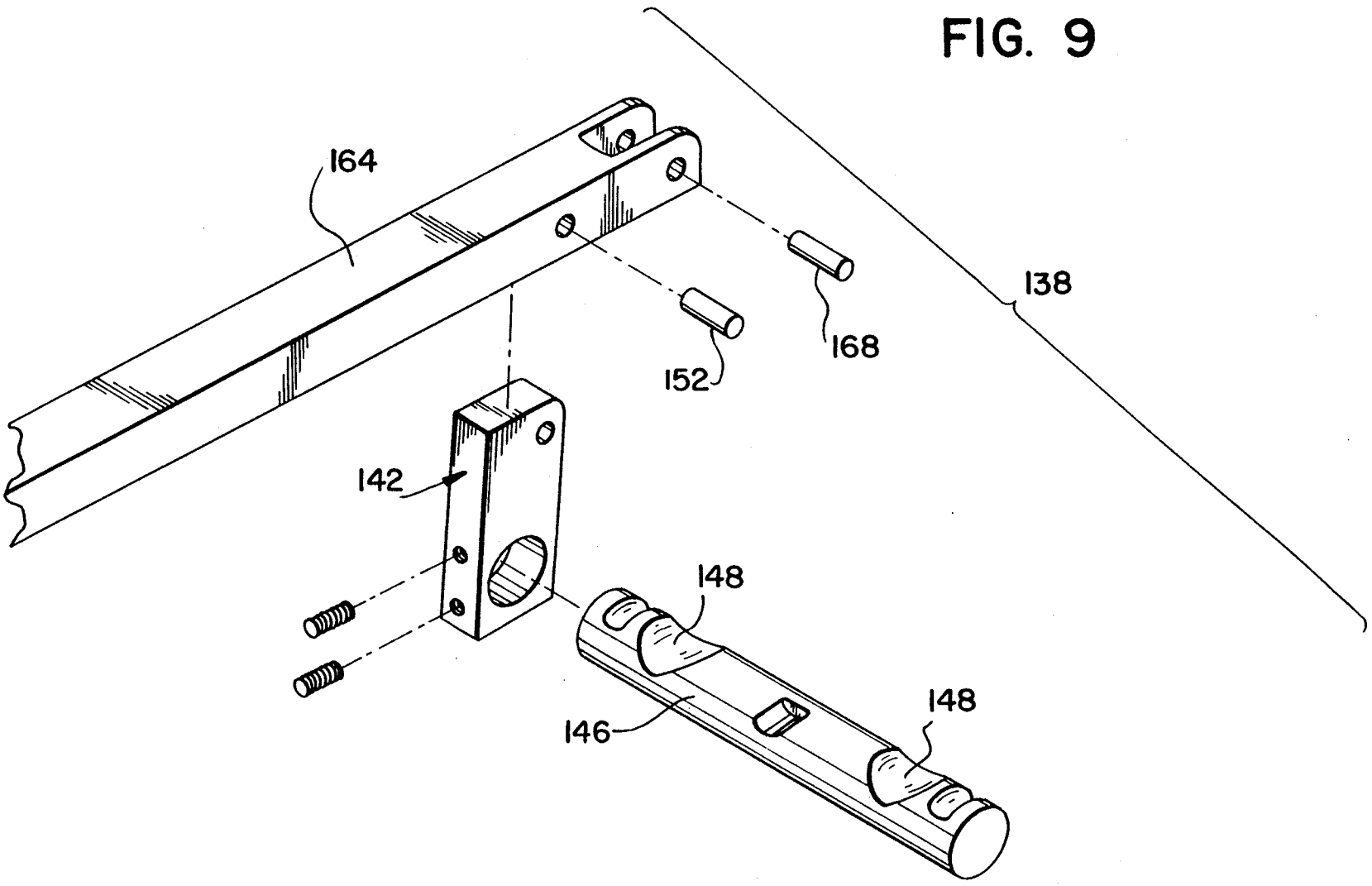
Figure 10:
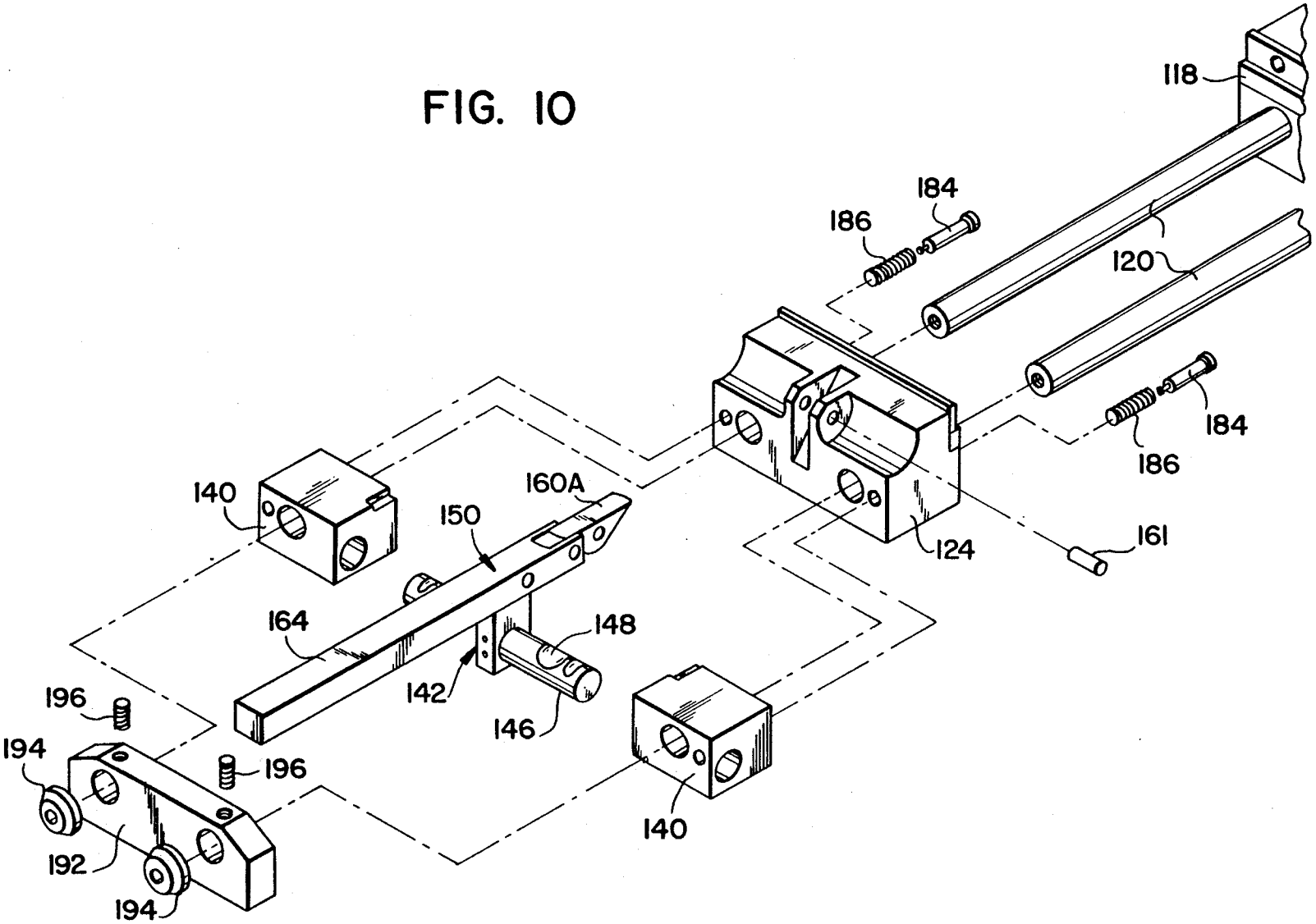
Figure 11:
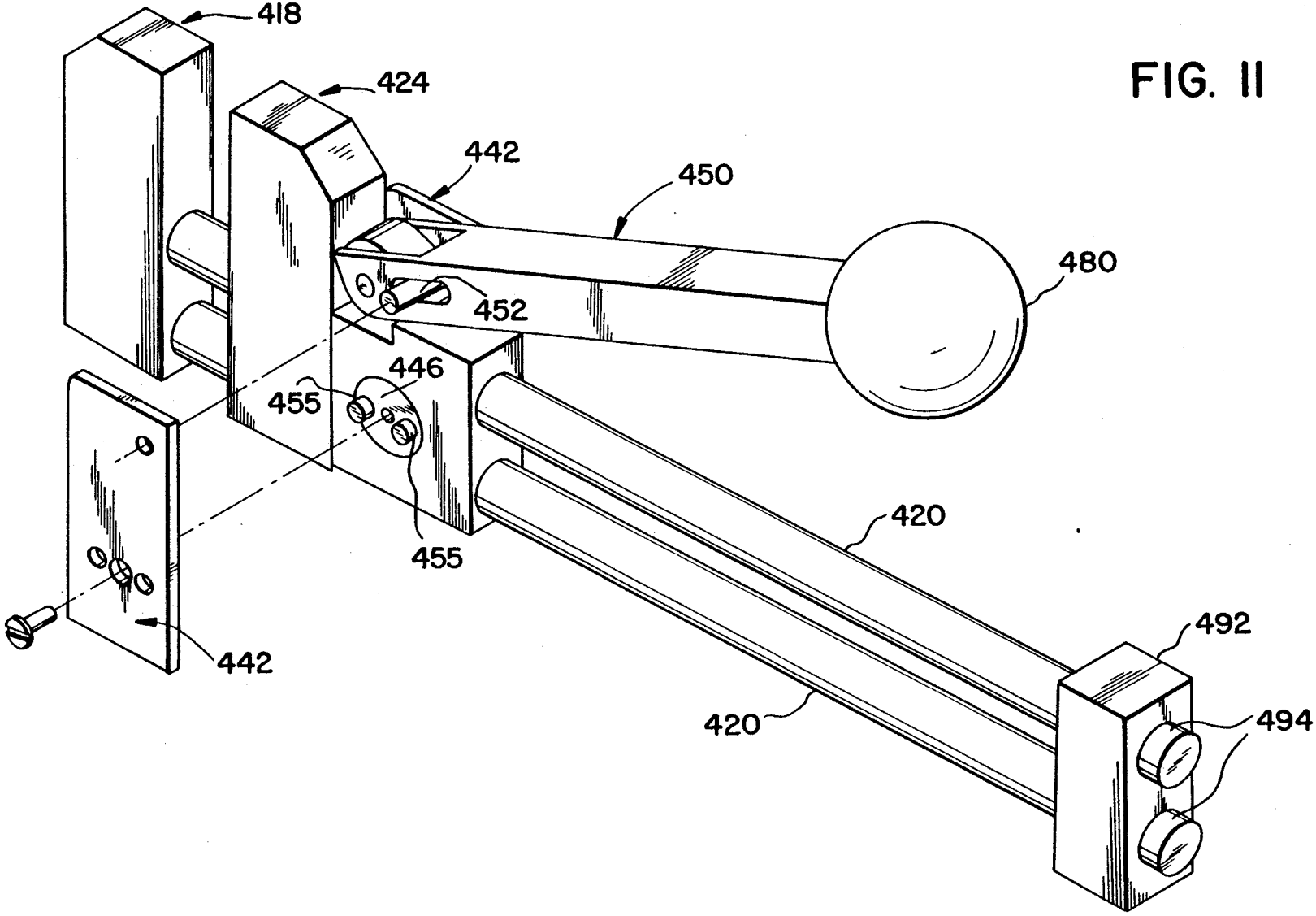
Figure 12:
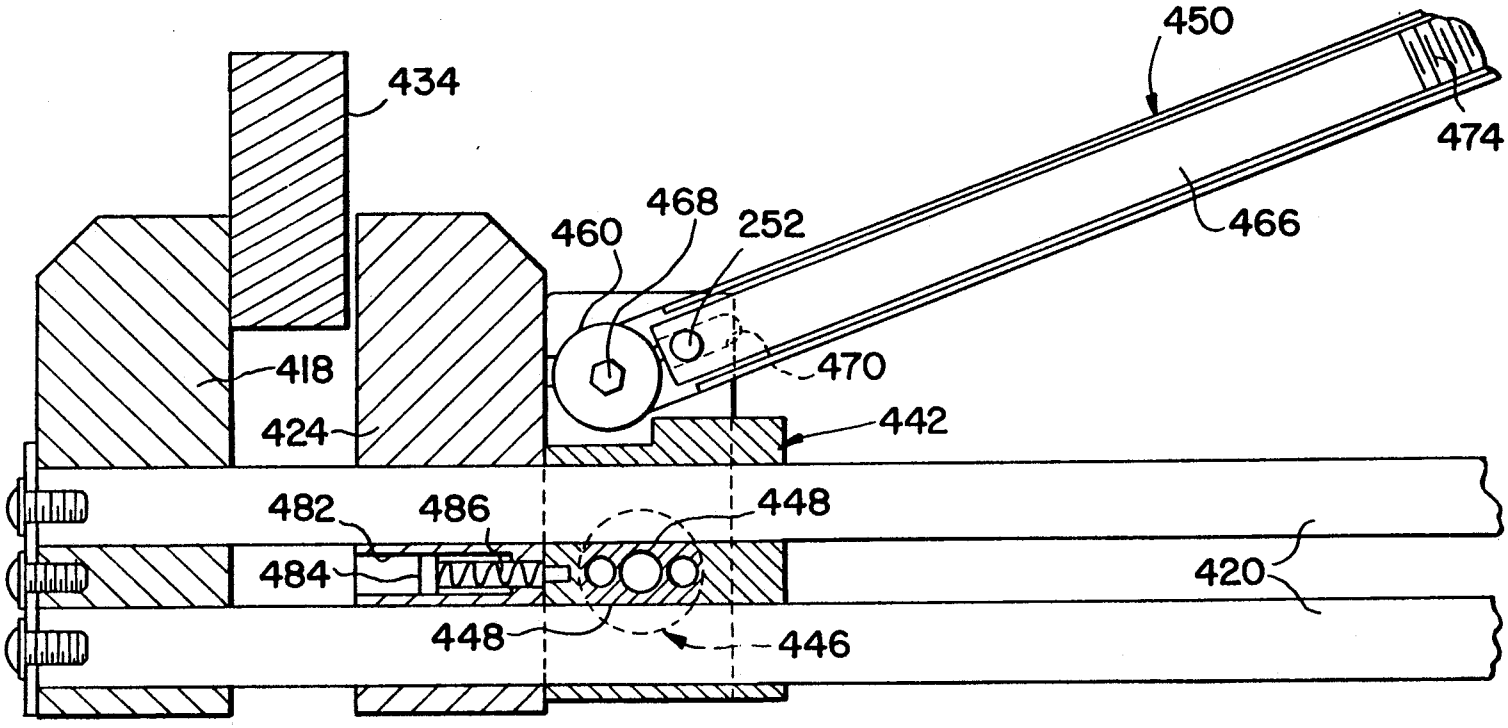
Figure 13:
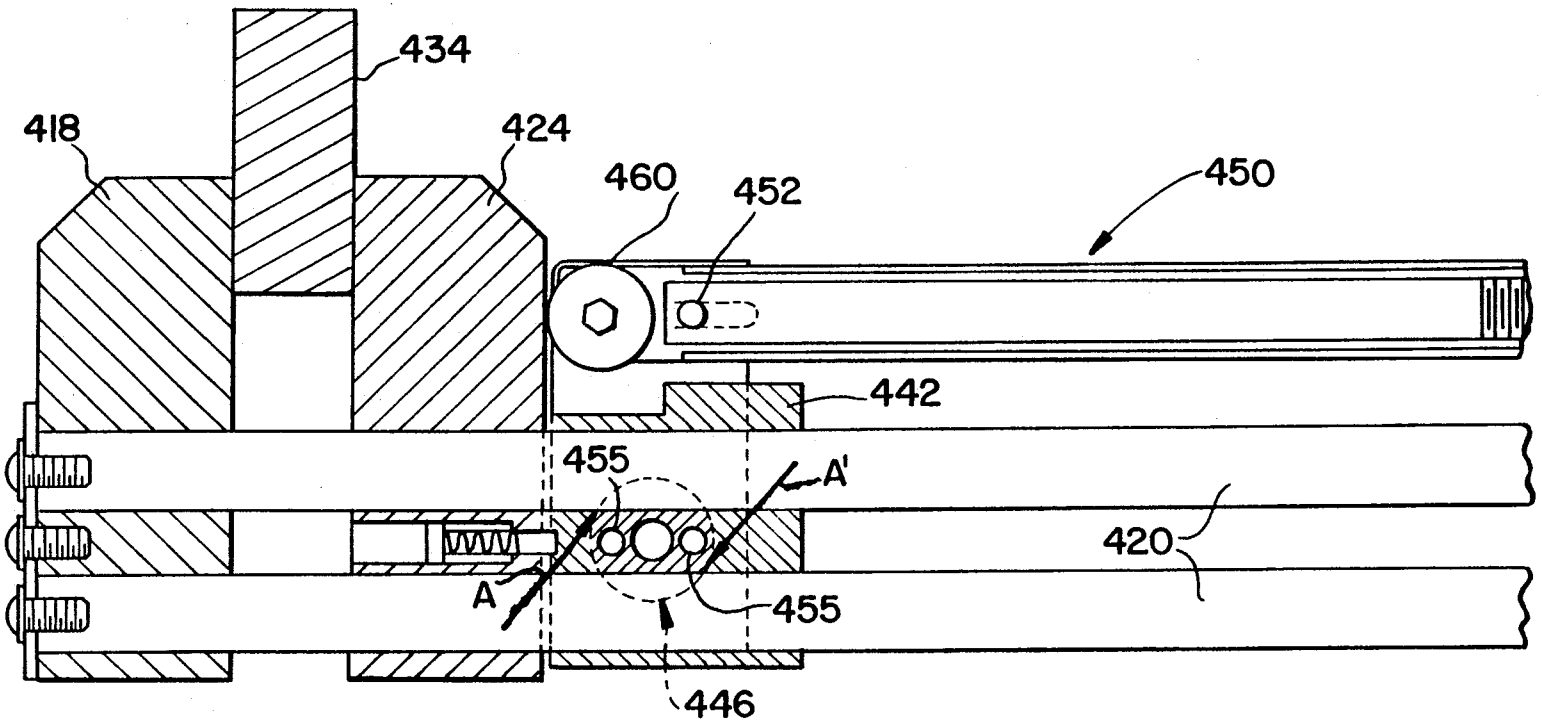

FIG. **6*a* is an isometric exploded view of the clamping mechanism of the device of FIG. 1**;

FIG. 7 is an isometric view, partly broken away and partly disassembled, showing another embodiment of this invention;

FIG. 8 is a view similar to FIG. 7 showing a further embodiment of this invention;

FIG. 9 is an isometric exploded view of another embodiment of a clamping mechanism incorporating this invention;

FIG. 10 is an isometric view, partly disassembled, showing a device incorporating the mechanism of FIG. 9;

FIG. 11 is an isometric view, partly disassembled, of a further embodiment of a clamping mechanism of this invention;

FIG. 12 is a side view, partly broken away and partly in section, showing the mechanism of FIG. 11 with its clamp handle in ready position; and FIG. 13 is a view similar to FIG. 12 with the clamp handle in clamping position.

DETAILED DESCRIPTION OF THE PREFERRED EMBODIMENTS

Referring now to the drawings in detail, a workpiece holding device incorporating this invention is illustrated in FIGS. **1–6*a* and is generally designated 10. Device 10 is mountable on a table 12 having a flat work surface 14. In FIGS. 7 and 8, a series of similar workpiece holding devices respectively designated 210 and 310** are shown arranged in side-by-side relation on a machine table and forming a vise fixturing assembly for multiple parts.

Figures 2A, 2B:
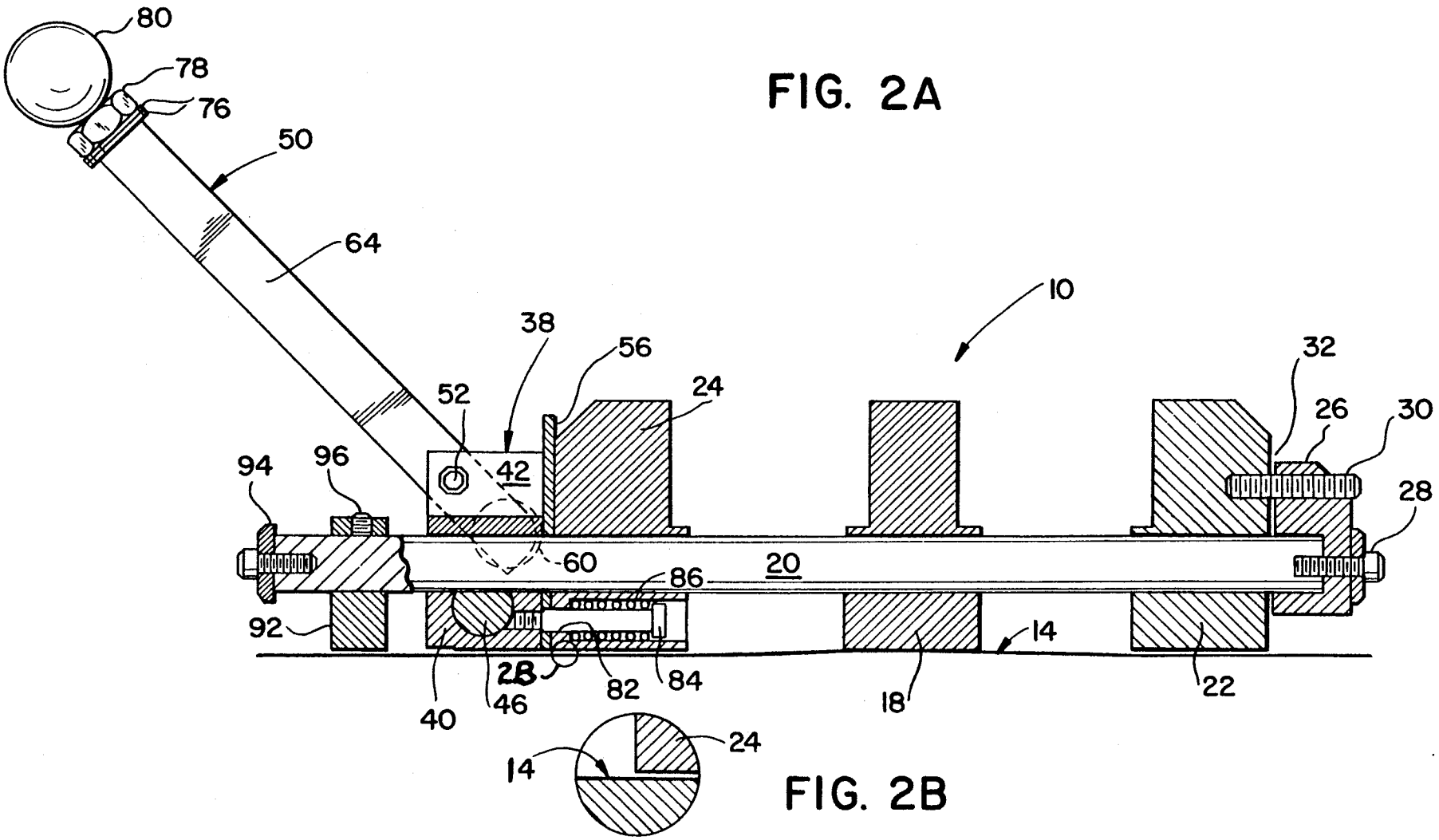
FIGS. 2A and 2B are side views, partly broken away and partly in section, showing the device of FIG. 1 with its clamp handle illustrated in a ready position.

Turning now to FIGS. **1–6*a*, device 10 includes a fixed jaw 18 which will be understood to be suitably secured to a support such as machine table 12 or flat base plate provided with the device and which is initially cleared of any chips to serve as a clean planar work surface (hereinafter called the "table"). A pair of rods 20, 20 extend through the fixed jaw 18 for sliding movement in parallel relation to the upper work surface 14 of table 12. A pair of jaws 22, 24 are mounted on the rods on opposite sides of the fixed jaw 18 for movement toward and away from that fixed jaw. Rear movable jaw 22 is slideable on the rods 20, 20 but is normally restrained from sliding by a thrust block 26 rigidly attached by suitable machine screws 28, 28 to rods 20, 20 and connected to movable jaw 22 by a threaded fastener 30 shown extending through thrust block 26 and into movable jaw 18. As best seen in FIG. 2, a discrete clearance at 32 is maintained between thrust block 26 and rear movable jaw 22**.

Rods 20, 20 not only provide a simple way of guiding the jaws 22, 24 for moving them toward and away from the fixed jaw 18 to secure workpieces such as shown at 34 and 36 in FIG. 5, but in accordance with this invention additionally serve to support an infinitely positionable clamping mechanism 38 while providing a particularly durable surface to be acted upon by that clamping mechanism. In the illustrated embodiment, clamping mechanism 38 includes a pair of apertured clamp blocks 40, 40 slideable on the rods 20, 20 with a cam lever 42 interposed between the blocks and fixed by a suitable key (FIGS. 4 and 6*a*) to a cam member comprising a hardened steel cam shaft 46 which extends through the cam blocks 40, 40 and through cam lever 42 in underlying perpendicular relation to the rods.

Figure 6:
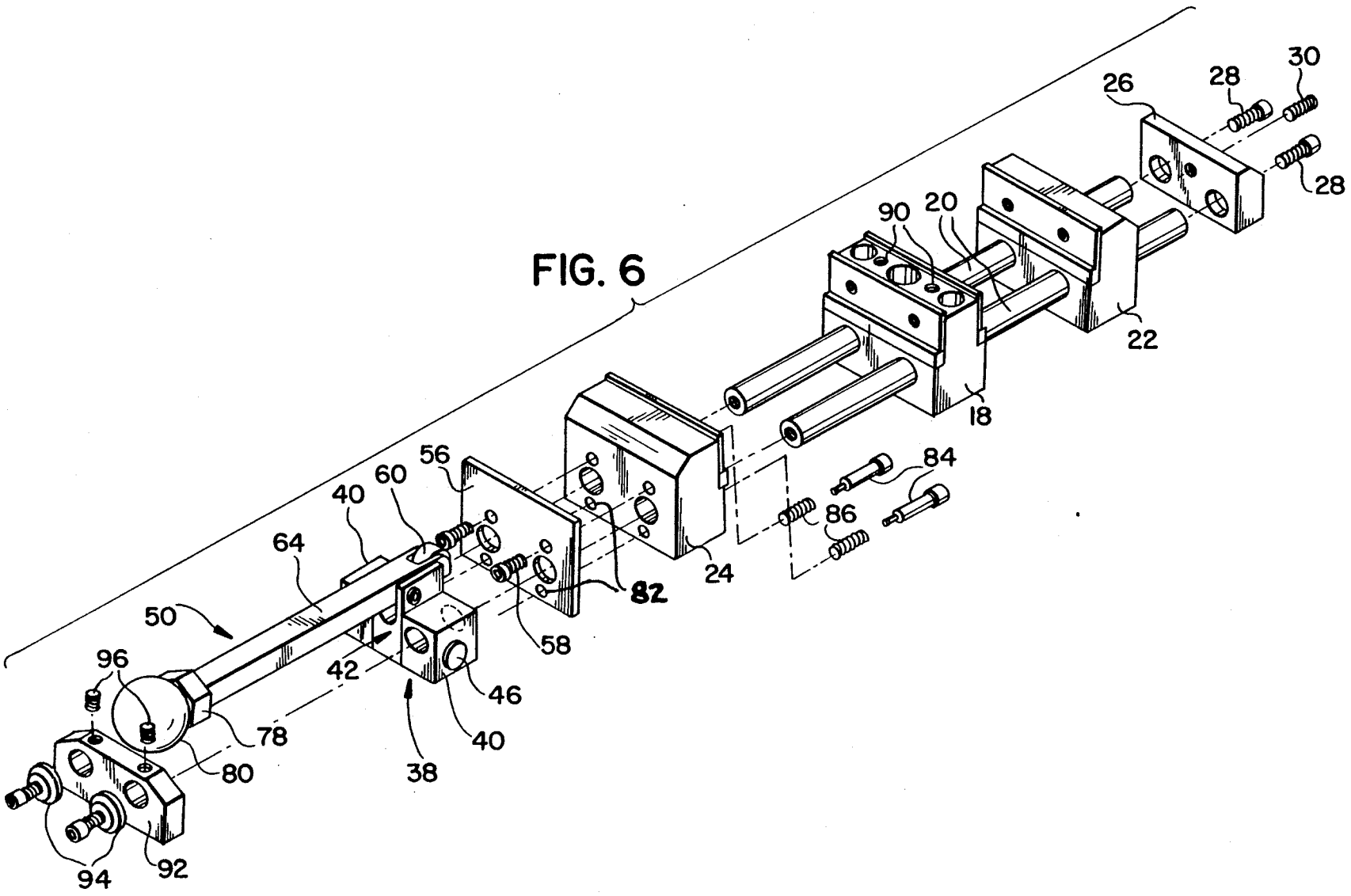
FIG. 6 is an isometric, partially exploded view showing details of the parts of the device of FIG. 1.
Figure 6A:
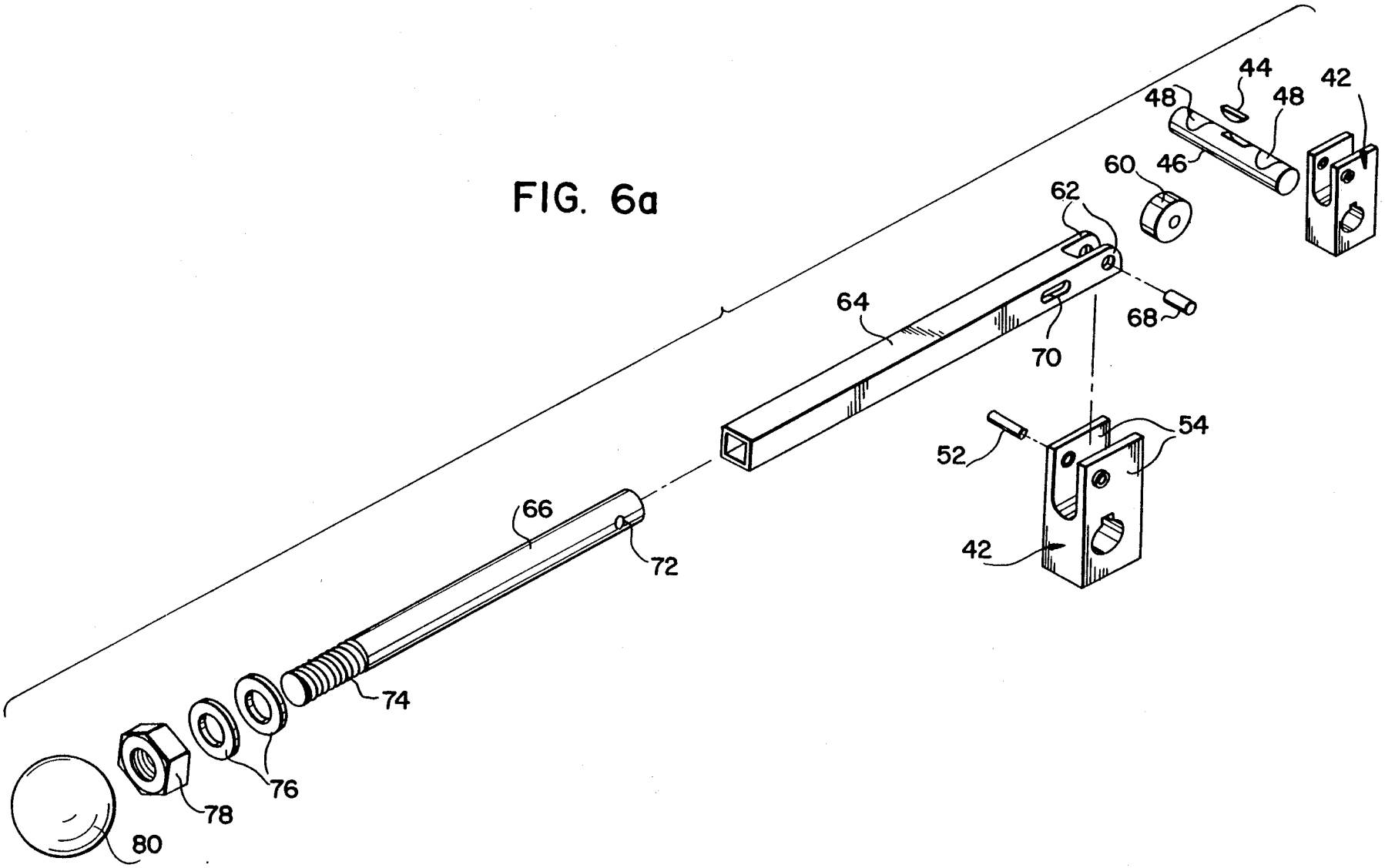

As best seen in FIG. 6*a*, this invention discloses an automatic clamping action which initially works as a friction lock in a self-energizing manner and then effects a clamping action which is highly effective. More specifically, a pair of peripheral recesses 48, 48 are formed in the cam shaft 46 for registration with the overlying guide rods 20, 20. To manually manipulate the clamping mechanism 38, a clamp handle 50 is pivotally mounted on a pin 52 extending between upstanding lugs 54, 54 of the cam lever 42, the clamping handle 50 being movable between a raised ready position (FIG. 2) and a lowered clamping positions (FIGS. 1 and 3–5) in generally parallel alignment with the underlying guide rods 20, 20.

To provide that durable surface for the cam shaft 46 and cam lever 42 to act upon, each guide rod 20, 20 may be made of "60 Case" (hardened to 60 Rockwell) ¾ inch diameter steel ground to accurate size. A hardened steel plate 56 is secured by machine screws such as at 58 to a face of front movable jaw 24 which is in confronting relation to the clamping mechanism 38, the plate 56 shown in this embodiment being acted upon by a suitable roller 60 mounted on a working end of handle 50.

More specifically, handle 50 is shown (FIG. 6*a*) having a bifurcated working end with a pair of apertured ears 62, 62 formed on a sleeve 64 of generally square cross section for receiving rod 66 of handle 50 with roller 60 rotatably supported between the ears 62, 62 by a suitable bearing 68. A pair of elongated slots such as at 70 are formed adjacent roller 60 in the sides of the sleeve 64 to register with a cross hole 72 formed in the rod 66 for receiving the pivot pin 52 mounting handle 50 to cam lever 42. Rod 66 is threaded at its swinging end 74 and has a pair of thrust washers 76, 76 captured between a hex nut 78 and sleeve 64. An operating knob 80 on the end of handle 50 will be understood to be internally threaded for engagement with the externally threaded end 74 of rod 66.

By virtue of the above structure, cam shaft lever 42 may be precisely oriented in a vertical position such that handle 50 is in raised ready position with cam shaft recesses 48, 48 lining up exactly to provide clearance between the cam shaft 46 and the overlying guide rods 20, 20. To ensure such precision alignment, openings such as at 82 are provided within movable jaw 24 and its hardened plate 56 to receive shoulder screws 84, 84 passing through springs 86, 86 and into threaded engagement within internally threaded openings 88, 88 formed in the clamp blocks 40, 40 confronting the hardened plate 56 of movable jaw 24. Accordingly, movable jaw 24 may be drawn toward the clamp blocks 40, 40 upon adjustment of the shoulder screws 84, 84 to cause the hardened plate on movable jaw to bear on cam shaft lever (FIG. 2) and urge it into a precisely oriented vertical position, whereby clamp blocks 40, 40 are released from guide rods 20, 20. It will be seen from FIGS. 3–5 that the center of cam shaft 46 is offset from a plane containing the major axes of the guide rods 20, 20 by a distance less than the sum of the guide rod radius and cam shaft radius. Such dimensioning, when coupled with precise matching of recesses 48, 48 with the radii of rods 20, 20, ensures the above described immediate frictional lock-up of shaft 46 onto rods 20, 20 responsive to even a discrete movement of handle 50 from its ready position toward its clamping position.

In use, workpiece 36 is initially placed between jaws 18 and 22 in contact with fixed jaw 18. Knob 80 of clamp handle 50 is grasped and moved from its ready position (FIG. 2) toward clamping position (FIGS. 1, 3–5), causing roller 60 to contact hardened plate 56 of movable jaw 24 and to rotate cam lever 42 and its cam shaft 46 counterclockwise as viewed in FIGS. 2–5. Because of the above described structural dimensioning of the parts, cam shaft 46 is immediately brought into intimate frictional bearing engagement against guide rods 20, 20 to automatically secure clamp blocks 40, 40 onto the guide rods. Movable jaw 22 then is drawn toward fixed jaw 18 upon retracting clamping mechanism 38 and the guide rods, it being understood that with jaws 18, 24 empty, the movable jaws 22, 24 both glide a few thousandths of an inch above the table surface 14 during this step. To then temporarily maintain rear movable jaw 22 in desired contact with workpiece 36 which is now in wedged engagement between jaws 22 and 18, set screws, (not shown), passing through openings 90, 90 in fixed jaw 18 (FIGS. 1, 6) are tightened into contact with the rods 20, 20 to maintain rear movable jaw 22 from moving out of position while a front workpiece such as at 34 is loaded.

That front workpiece 34 then is placed between jaws 18 and 24 in contact with fixed jaw 18. Clamp handle 50 is returned into ready position, wherein clamping mechanism 38 is free to move on rods 20, 20, and then pushed toward the fixed jaw 18 to advance jaw 24 and clamp blocks 40, 40 on the guide rods until that front movable jaw 24 contacts the front workpiece 34. With the jaws 22, 24 now properly positioned, a stop block 92, slidably mounted on the guide rods between end stops 94, 94 and clamp blocks 40, 40, is advanced on guide rods into contact with the clamp blocks. Set screws 96, 96 passing through stop block 92 are then tightened against rods 20, 20 to assist in maintaining clamp blocks 40, 40 in place.

With both workpieces 34, 36 thus loaded, set screws within openings 90, 90 in jaw 18 are loosened, and an operative clamping force is now applied to resist undesired workpiece movement during subsequent machining operations. Clamp handle 50 is moved from its ready position toward clamping position whereupon the cam shaft 46 instantly grabs rods 20, 20. As roller 60 contacts plate 56 on movable jaw 24 and rolls upwardly on its surface responsive to handle 50 being pivoted down into clamping position, the frictional locking forces applied by shaft 46 onto the guide rods progressively increase directly with continued upward movement of roller 60 to force that plate 56 and attached jaw 24 against workpiece 34 while simultaneously rotating cam shaft lever 42 and its keyed shaft 46 counterclockwise about the axis of shaft 46 (as viewed in FIGS. 2–5) responsive to an equal and opposite reaction force (F in FIG. 5) applied to clamp handle pivot pin 52.

As handle 50 is being further depressed, movable jaw 24 is driven in one linear direction (to the right as viewed in the drawings) against workpiece 34, clamping it to fixed jaw 18. Clamp blocks 40, 40 are simultaneously forced in the opposite linear direction, thus carrying rods 20, 20 and, consequently the rear movable jaw 22, to the left as viewed in the drawings. Movable jaw 22 accordingly clamps workpiece 36 to the other side of fixed jaw 18.

The operative clamping force applied by the disclosed clamping mechanism 38 may be adjusted, and such adjustment is facilitated by the provision of roller 60. Hex nut 78 is readily tightened against both thrust washers 76, 76 and the end of sleeve 64 to increase the distance between clamp handle pivot pin 52 and the roller 60 (FIG. 4), thereby increasing the clamping force applied by the mechanism. The more clamping force applied, the tighter the frictional grip which is applied to lock clamp blocks 40, 40 onto rods 20, 20 to effect the above noted self-energizing mechanism. Likewise, loosening the hex nut 78 to decrease the distance between the pin 52 and the roller 60 decreases the clamping force. It will be appreciated by those skilled in this art that the ratio between the effective lever arm length of handle 50 and the width of clamps 22, 24 may be critical, for continued motion of handle 50 toward its clamping position continues to apply ever increasing clamping force to movable jaw 24. It has been found that the above noted ratio should be maintained between about 4:1 and about 5:1 to ensure clamping mechanism release while still providing an effective self-clamping frictional locking action of shaft 46 onto rods 20, 20.

Once the operative clamping force has been properly adjusted, that adjustment may be readily secured by tightening knob 80 against the hex nut 78. With the stop bar 92 and clamping force properly set, the workpieces 34, 36 then are laterally located as desired in the jaws. Moving the handle 50 then into clamping position to bottom against stop bar 92 will clamp both front and rear workpieces 34, 36 with equal force, and the clamping pressure applied will be uniform from part to part as long as the parts are the same size.

By virtue of the above described structure, this invention additionally automatically provides for a discrete downward movement of the movable jaws, responsive to deflection of the rods, into direct abutting contact with the work surface 14 of the underlying table 12 during the above described movement of handle 50 into its clamping position. Such action, wherein the movable jaws 22, 24 are drawn down flat onto the table 12, is caused by the forces F and −F (FIG. 5) counteracting the above noted operative clamping forces and which form couples wherein a moment of each couple A, $A^1$ rotates as shown in FIG. 5 to drive the movable jaws 22, 24 downwardly into direct abutment with the underlying surface 14. Accordingly, it will be seen that the movable jaws do not float and thus merely rely on the rods to support them in their clamped condition as normally provided by known conventional devices. Instead, the movable jaws of this invention draw down flat onto the table such that the jaws are not subject to absorbing the cutting forces thereafter applied to the workpieces. Rather, such cutting forces are desirably transferred directly to the machine table.

As seen in FIGS. 2 and 3–5, the threaded member 30 connecting thrust block 26 to rear movable jaw 22, and which maintains the discrete clearance 32, is so located that its major axis is contained in a common plane with the axes of roller 60 and pin 52 when the handle 50 is in clamping position. Thus, when stressed by clamping forces, rear movable jaw 22 is permitted to move downward (a matter of a few thousandths of an inch) while remaining in parallel with fixed jaw instead of slightly inclining as guide rods deflect.

Once the workpieces have been machined, the handle 50 may be raised into ready position to release both jaws 22, 24 just enough to free the workpieces, but no further. Chips on the table 12 will not interfere with this minimal amount of jaw movement.

Turning now to further embodiments of this invention shown in FIGS. 7 and 8, as one skilled in the art will recognize, there are many practical advantages in simply leaving a fixed jaw undisturbed on a machine table and rearranging only the movable jaws of a vise as distinguished from the conventional practice of moving each separate movable jaw and fixed jaw of a number of more narrow vises to accommodate longer and shorter pieces to be machined in different operations. The invention disclosed in FIGS. 7 and 8 also is not limited, as is the known art, to utilizing the same maximum length part for each jaw. Rather, by providing one elongated fixed jaw 218 and 318 (FIGS. 7 and 8, respectively) in accordance with this invention, a multiple workpiece vise fixturing assembly is provided wherein a series of several individual pairs (or sets) of movable jaws may be accommodated as illustrated and which is particularly useful for vertical CNC machining centers.

E.g., these individual sets of movable jaws such as shown at 222, 224 in FIG. 7 may operate on guide rods 220 spaced 2½ inches apart on center and occupying every second hole in one common fixed jaw 218 having a series of holes such as at 225 equally spaced apart on center. Assuming that the rods 220 for a vise are spaced apart a standard 2½ inches on center and that a given fixed jaw 218 for a particular machine table has, say, twenty-one holes (as at 225) for receiving the rods of such vises with adjacent holes spaced apart 1¼ inches on center, such an arrangement would provide quick and easy clamping of two workpieces per vise and would allow the use of seven sets of movable jaws (222, 224), say, 3½ inches wide each, and holding fourteen parts as long as these parts each were not over 3¾ inches in length. For longer parts up to 5 inches in length, the spacing between vises could be increased by one hole (1¼ inches) in the fixed jaw 218.

In FIG. 8, yet another increment in jaw spacing is shown provided for pieces up to 7½ inches long; wider movable jaws, say, 5⅞ inches wide, are illustrated at 322, 324 (replacing the 3½ inches wide movable jaws 222, 224 used in the embodiment of FIG. 7), whereby four such sets of wider movable jaws are accommodated.

In the embodiments of both FIGS. 7, and 8, the common fixed jaws 218 and 318, shared by the side-by-side series of movable jaw sets, are respectively shown fastened by means of the illustrated bolts such as at 235 and 335 with the head of each bolt retained within a selected tee slot 245, 345 respectively formed in the face of machine table 212, 312. The jaws are secured upon tightening nuts 255, 355 onto bolts 235, 335. As in the embodiment of FIGS. 1-6*a*, the clamping mechanism of the jaw sets of FIGS. 7 and 8 operates as previously described. It will be understood that the described configuration wherein multiple vises share one common fixed jaw can be ideal for machining families of parts of one or more different machining sequences and is particularly useful for CNC machining centers in different mounting arrangements and alignments of a multiplicity of parts for maximizing fixturing flexibility and increasing precision machining productivity. The described multi-station vise assembly is quick and easy to adjust and has yet further flexibility in being readily adapted to handle parts having increased width dimensions by simply locating the common fixed jaw 218 or 318 in a rear tee slot such as at 265 (FIG. 7) or 365 (FIG. 8) and setting the rear movable jaw opening to zero by drawing the rear movable jaws 222, 322 into direct contact with the confronting rear face of the relocated fixed jaw 218, 318, whereby the width capacity of the front jaw in the embodiments illustrated is about doubled.

The described invention permits a user to hold multiple parts or workpieces at one time for maximizing economy and efficiency. The close spacing of separate vises optimizes vise intimacy wherein a common fixed jaw and a plurality of movable jaw pairs or sets are readily adapted to be arranged in different spacings and with different size movable jaw sets to match multiple workpieces of different lengths without having to accommodate different workpiece lengths by using one, two or three jaws per workpiece. While primarily intended for holding multiple workpieces, the disclosed common fixed jaw arrangements of FIGS. 7 and 8 are also ideal for holding a double row of long workpieces extending the full active length of the machine table.

In summary, it will be seen that the work holding device 10 combines a low profile with great rigidity due to intimate contact of the jaws directly with the machine table itself. The fixed jaw 18 will be understood to be bolted fast. The movable jaws 22, 24 glide a few thousandths of an inch above the table 12 when free but are forced down against it by the clamping action and rest firmly on it when clamped. To gain this feature, the clamping mechanism 38 must be capable of transmitting a clamping force directly to jaw 24 sufficient to bend, say, ¾ inch diameter "60 Case" hardened guide rods until both movable jaws 22, 24 bear firmly on the table 12. As described, these round rods only guide the parts slideable on them; they do not absorb the cutting forces which instead are directly transferred to the machine table. The described cam mechanism 38 is inherently low friction. As roller 60 moves up to center (and slightly over center to lock), the mechanical advantage increases theoretically to infinity at the conclusion of its throw. While the disclosed embodiment depicts an inverse cam mechanism wherein roller 60 pushes cam lever 42, other alternate mechanisms are contemplated including conventional toggle mechanisms such as that described and shown in my U.S. Pat. No. 2,528,909 entitled "Work Holder", the teachings of which are incorporated herein by reference.

An alternate clamping mechanism 138 is shown in FIGS. 9 and 10 wherein like parts are identified by the same numbers as in the first described embodiment of FIGS. 1-6*a* increased by 100. As in the first embodiment, mechanism 138 is readily movable on rods 120, 120 to slide into engagement with a workpiece while instantly engaging guide rods 120, 120 in intimate frictional contact and advancing jaw 124 upon continued rotating movement of cam shaft 146. Such action is effected by precisely machined peripheral grooves 148, 148 in shaft 146 which register with matching the contoured surfaces of rods 120, 120. As illustrated, cam lever 142 immediately acts to frictionally grip each guide rod responsive to any downward angular movement of clamp handle 150 from its ready position, not shown, into its illustrated clamping position. Toggle 160 is pivoted on handle 150 and linked by a cross pin 161 to movable jaw 124 to selectively advance that jaw toward fixed jaw 118 to effect the above described operative clamping force as in the first described embodiment of this invention. The other numbered parts corresponding to like parts of the first described embodiment operate in precisely the same manner as previously described.

The clamping mechanism 438 of FIGS. 11-13 will be understood to operate similarly to the above described clamp mechanisms 38 and 138, but a different cam mounting arrangement is shown wherein cam shaft 446 is located between rods 420, 420. Clamp handle 450 is illustrated in FIGS. 11, 12 in ready position and will be seen to be pivotable about cam shaft 446 into a clamping position wherein handle 450 moves into a position slightly over center in generally parallel relation to the rods 420, 420 with roller 460 applying a progressively increasing clamping force against movable jaw 424 while cam levers 442, 442 are driven clockwise as viewed in the drawings. As in the other embodiments, mechanism 438 is slidably mounted on guide rods 420, 420 and connected by screw 484 to movable jaw 424 for selective engagement with the guide rods. The cam shaft 446 is shown located between the two parallel guide rods 420, 420 with recesses 448, 448 in shaft 446 registering with the arcuate guide rod surfaces to provide almost instantaneous frictional locking action by shaft 446 to grip the rods responsive to rotation of pin 452 which drives levers 442,442 through pins 455, 455. Thus, rods 420, 420 are forced away from one another by forces A, $A^1$ (FIG. 13) applied by cam shaft 446 while exerting the required clamping force on workpiece 434 positioned between the fixed and movable jaws 418, 424.

It will be appreciated by those skilled in the art that the disclosed simplicity of the described construction provides for quick and easy manufacture and assembly at relatively low cost while providing an integrated, modular, low profile and adaptable vise fixturing system for extended and reliable service under demanding condition.

As will be apparent to persons skilled in the art, various modification, adaptations, and variations of the foregoing specific disclosure can be made without departing from the teachings of this invention.

I claim:

1. A workpiece holding device comprising fixed jaw means, a pair of guide rods extending through the fixed jaw means, movable jaw means mounted on the guide rods for movement toward and away from the fixed jaw means, and a clamping mechanism slidably mounted on the guide rods and connected to the movable jaw means, the clamping mechanism having a cam shaft rotatable about an axis perpendicular to the guide rods, the cam shaft having a pair of recesses formed thereon dimensioned and configured to register with surfaces of the guide rods for selectively engaging the guide rods in self-clamping frictional locking relation.

2. The device of claim 1 wherein the clamping mechanism further includes a cam lever mounted for sliding movement on the guide rods, the cam shaft being fixed to the cam lever, and a clamp handle mounted on the cam lever for pivoting movement between a ready position, wherein the clamping mechanism is freely slidable along the guide rods, and a clamping position, and wherein the cam shaft engages the guide rods in said self-clamping frictional locking relation upon displacement of the clamp handle from its ready position toward its clamping position, the cam shaft being infinitely positionable and engageable along the guide rod length, the cam shaft and guide rods being in direct driving relation to one another for moving the clamping mechanism and the guide rods in unison axially of the guide rods responsive to displacement of the clamp handle from its ready position.

3. The device of claim 2 wherein the frictional locking relation between the cam shaft and guide rods progressively increases responsive to increased angular displacement of the clamp handle from its ready position toward its clamping position.

4. The device of claim 2 wherein the clamp handle is engageable with the movable jaw means for driving the movable jaw means toward the fixed jaw means responsive to movement of the clamp handle from its ready position to its clamping position.

5. The device of claim 4 wherein a pivot pin supports the clamp handle on the cam lever and serves to rotate the cam lever and its cam shaft responsive to pivoting movement of the clamp handle.

6. The device of claim 1 wherein mounting means is provided on the guide rods for supporting the cam shaft for rotation about an axis spaced from the axes of the guide rods a distance less than the sum of the cam shaft and guide rod radii.

7. The device of claim 1 wherein the shaft is formed of steel hardened to 60 Rockwell.

8. The device of claim 2 wherein the clamp handle includes one end having a roller adjacent its pivot mounting on the cam lever, the roller being engageable with the movable jaw means when the clamp handle is moved from its ready position toward its clamping position for pivoting the cam lever and rotating its cam shaft.

9. The device of claim 8 further including adjustment means on the clamp handle for increasing and decreasing the effective distance between centers of the clamp handle pivot mounting and the roller for increasing and decreasing the clamping pressure applied by the roller against the movable jaw means.

10. A workpiece holding device comprising fixed jaw means, a pair of guide rods extending through the fixed jaw means, movable jaw means mounted on the guide rods for movement toward and away from the fixed jaw means, and a clamping mechanism slidably mounted on the guide rods and connected to the movable jaw means, the clamping mechanism having a cam member rotatable about an axis perpendicular to the guide rods for selectively engaging the guide rods in self-clamping frictional locking relation, the cam member comprising a shaft, the shaft including a pair of recesses formed thereon, the recesses being dimensioned and configured to match the guide rod surfaces, and resilient connecting means provided for normally maintaining the cam shaft and guide rods in preselected relative positions providing a clearance therebetween to permit relative sliding movement of the clamping mechanism on the guide rods.

11. The device of claim 10 wherein the clamping mechanism further includes a clamp handle, and a cam lever mounted for sliding movement on the guide rods, the cam shaft being fixed to the cam lever, the clamp handle being mounted on the cam lever for pivoting movement between a ready position and a clamping position, the cam shaft and guide rods being in said preselected relative positions providing a clearance therebetween when the clamp handle is in its ready position, and the cam shaft engaging the guide rods in said self-clamping frictional locking relation upon movement of the clamp handle from its ready position.

12. A workpiece holding device comprising a support having a flat work surface, a fixed jaw secured to the support, a pair of parallel guide rods extending through the fixed jaw for sliding movement parallel to the work surface, a pair of jaws mounted on the guide rods on the opposite sides of the fixed jaw for movement toward and away from the fixed jaw, and a clamping mechanism slidably mounted on the guide rods and connected to one of the movable jaws, the clamping mechanism having a cam shaft rotatable about an axis perpendicular to the guide rods for selective engagement therewith in self-clamping frictional locking relation, the cam shaft including a pair of recesses formed thereon, the recesses being dimensioned and configured to match the guide rod surfaces, and resilient connecting means provided for normally maintaining the cam shaft and guide rods in preselected relative positions providing a clearance therebetween permitting relative sliding movement of the clamping mechanism on the guide rods.

13. The device of claim 12 wherein the clamping mechanism further includes a clamp handle, and a cam lever mounted for sliding movement on the guide rods, the cam shaft being fixed to the cam lever, the clamp handle being mounted on the cam lever for pivoting movement between a ready position and a clamping position, the cam shaft and guide rods being in said preselected relative positions providing a clearance therebetween when the clamp handle is in its ready position, and the cam shaft engaging the guide rods in said self-clamping frictional locking relation upon movement of the clamp handle from its ready position to pivot the cam lever and rotate the cam shaft.

14. The device of claim 12 wherein the clamping mechanism further includes a pair of clamp blocks slidably supported on the guide rods and drivingly connected to said one movable jaw, wherein the clamp blocks rotatably support the cam shaft, wherein a cam lever is fixed to the cam shaft, and wherein a clamp handle is supported on the cam lever for movement in opposite angular directions for engaging and disengaging said locking relation between the cam shaft and the guide rods responsive to the clamp handle applying and releasing a clamping force on said one movable jaw.

15. The device of claim 12 wherein the guide rods are movable by the clamping mechanism in a first linear direction to draw the other movable jaw toward the fixed jaw into a ready clamping condition to secure a workpiece therebetween.

16. The device of claim 15 including releasable locking means between the fixed jaw and at least one of the guide rods for temporarily securing said other movable jaw in its ready clamping condition, said one movable jaw being movable by the clamping mechanism in a direction opposite said first linear direction to advance said one movable jaw toward the fixed jaw into ready clamping condition while said other movable jaw is maintained by the releasable locking means in its ready clamping condition.

17. The device of claim 16 wherein the clamping mechanism further includes a pair of clamp blocks slidably supported on the guide rods and drivingly connected to said one movable jaw, wherein the clamp blocks rotatably support the cam shaft, wherein a cam lever is fixed to the cam shaft, and wherein a clamp handle is supported on the cam lever for movement in opposite angular directions for engaging and disengaging said locking relation between the cam shaft and the guide rods responsive to the clamp handle applying and releasing a clamping force on said one movable jaw, wherein upon release of the locking means, the clamp handle is movable from its ready position causing said self-clamping frictional locking action between the cam shaft and the guide rods, and wherein continued movement of the clamp handle toward its clamping position drives each of the movable jaws toward the fixed jaw into workpiece clamping engagement.

18. The device of claim 17 wherein movement of the clamp handle from ready position into clamping position causes the guide rods to draw the other movable jaw in said first linear direction toward the fixed jaw and drives the first movable jaw in an opposite linear direction toward the fixed jaw.

19. The device of claim 12 wherein the movement of the clamp handle from ready position to clamping position simultaneously causes the guide rods to force the movable jaws into fixed abutting contact with the work surface.

20. The device of claim 12 wherein the support comprises a work surface of sufficient size to support a multiplicity of workpieces, and wherein the fixed jaw comprises a single elongated unit fixed to the support and is dimensioned and configured to accommodate a series of pairs of said movable jaws in side-by-side relation for holding a multiplicity of workpieces against the common fixed jaw.

21. A workpiece holding device comprising a support having a flat work surface, a fixed jaw secured to the support, a pair of parallel guide rods extending through the fixed jaw for sliding movement parallel to the work surface, a pair of movable jaws supported on the guide rods for movement toward and away from the fixed jaw, the movable jaws in a clamping condition each being engageable with a workpiece sandwiched between that movable jaw and the fixed jaw, a cam lever mounted for sliding movement on the guide rods, a cam shaft fixed to the cam lever for rotation about an axis perpendicular to the guide rods for selectively engaging the guide rods in self-clamping frictional locking relation, a clamp handle mounted on the cam lever for pivoting movement between a ready position and a clamping position, the cam shaft and guide rods being in preselected relative positions providing a clearance therebetween when the clamp handle is in its ready position, the cam shaft and the guide rods providing a drive connection upon their being engaged in said self-clamping frictional locking relation upon movement of the clamp handle from its ready position, the clamp handle engaging one of the movable jaws upon displacement from said ready position for moving the cam lever and cam shaft to automatically effect said frictional locking action which progressively increases responsive to advancement of the clamp handle toward its clamping position, said advancement of the clamp handle toward its clamping position serving to apply force couples through said drive connection provided by the cam shaft and the guide rods to deflect the guide rods to drive the movable jaws downwardly into fixed abutting engagement with the support.

22. The device of claim 21 wherein the clamp handle has a pivoted end mounted on the cam lever, wherein a cam assembly is provided having a pair of cam blocks each of which are apertured for receiving the guide rods, the cam lever supporting the pivoted end of the clamp handle and disposed between the cam blocks, the cam shaft being keyed to the cam lever and extending through the cam blocks in underlying perpendicular relation to the guide rods, the cam shaft having peripheral recesses thereon for receiving the guide rods for free sliding movement when the clamp handle is in a ready position, the clamp handle being pivotable from its ready position toward a clamping position for frictionally locking the guide rods relative to both the cam shaft and to the clamp blocks responsive to engagement of the clamp handle against said one movable jaw, movement of the clamp handle into its clamping position being operative to provide said drive connection between the cam shaft and the guide rods and to effect a final clamping action to draw the other movable jaw in a direction of movement toward the fixed jaw and downwardly into abutting engagement with the work surface.

23. The device of claim 21 wherein the clamp handle includes a roller on a free pivoting end engageable with said one movable jaw upon movement of the handle from its ready position toward its clamping position to drive said one movable jaw in a direction away from the clamping blocks and into fixed abutting engagement with the work surface.

24. A workpiece holding device comprising a support having a flat work surface of a given size suitable for fixturing a multiplicity of parts, a first series of movable jaws being arranged on the support in side-by-side relation, a second series of movable jaws being arranged on the support in side-by-side relation, the individual jaws of each series being in spaced opposed alignment with the individual jaws of the other series and forming a plurality of pairs of movable jaws, a pair of guide rods supporting each pair of movable jaws, and a unitary elongated jaw fixed to the support and extending substantially the full length of the support, the fixed jaw having a plurality of apertures therethrough for receiving the guide rods of each of the pairs of movable jaws for sliding movement, the number of apertures in the fixed jaw being greater than the number of operating rods, and the apertures in the fixed jaw being uniformly spaced apart, whereby the pairs of movable jaws of a given width may be replaced with other pairs of movable jaws of a different width, the distance between centers of the guide rods of the different pairs of movable jaws being uniform and corresponding to the spacing between centers of the apertures in the common fixed jaw shared by the multiple pairs of movable jaws.

25. The device of claim 24 wherein the work surface has a plurality of tee slots formed therein in parallel alignment with one another and in perpendicular relation to the guide rods, and wherein fastener means is provided to secure the fixed jaw in a selected tee slot to provide predetermined spacing between the fixed and movable jaws.

* * * * *